US008591357B1

(12) United States Patent
Bonds et al.

(10) Patent No.: US 8,591,357 B1
(45) Date of Patent: Nov. 26, 2013

(54) HELIX WOOD BASEBALL BAT

(76) Inventors: Frederick Roy Bonds, Isabella, MI (US); Derek Michael Bonds, Isabella, MI (US)

( * ) Notice: Subject to any disclaimer, the term of this patent is extended or adjusted under 35 U.S.C. 154(b) by 124 days.

(21) Appl. No.: 13/355,753

(22) Filed: Jan. 23, 2012

Related U.S. Application Data

(60) Provisional application No. 61/461,864, filed on Jan. 24, 2011.

(51) Int. Cl.
*A63B 59/06* (2006.01)

(52) U.S. Cl.
USPC ..... 473/564; 473/568

(58) Field of Classification Search
USPC ..... 473/457, 519, 520, 564–568
See application file for complete search history.

(56) References Cited

U.S. PATENT DOCUMENTS

| | | | | |
|---|---|---|---|---|
| 780,244 | A * | 1/1905 | Truesdell | 473/564 |
| 1,585,857 | A * | 5/1926 | Hedenskoog | 473/120 |
| 3,152,804 | A * | 10/1964 | Costopoulos | 473/120 |
| 3,257,113 | A * | 6/1966 | Medney | 473/120 |
| 3,598,410 | A * | 8/1971 | Costopoulos | 473/120 |
| 5,042,805 | A * | 8/1991 | Nakai | 473/320 |
| 6,036,610 | A * | 3/2000 | Lewark | 473/564 |
| 6,139,451 | A * | 10/2000 | Hillerich et al. | 473/564 |
| 6,238,309 | B1 * | 5/2001 | Sample | 473/564 |
| 6,352,485 | B1 * | 3/2002 | Philpot et al. | 473/564 |
| 7,448,971 | B1 * | 11/2008 | Smalley | 473/564 |
| 8,425,353 | B2 * | 4/2013 | Jones et al. | 473/564 |
| 2004/0194521 | A1 * | 10/2004 | Andrews | 72/53 |
| 2009/0065299 | A1 * | 3/2009 | Vito et al. | 181/294 |
| 2010/0317469 | A1 * | 12/2010 | Comello et al. | 473/568 |
| 2012/0129634 | A1 * | 5/2012 | Jones et al. | 473/564 |
| 2013/0045823 | A1 * | 2/2013 | Sublett, Sr. | 473/564 |

FOREIGN PATENT DOCUMENTS

| | | | |
|---|---|---|---|
| JP | 02149280 | A * | 6/1990 |

* cited by examiner

*Primary Examiner* — Mark Graham

(57) ABSTRACT

A bat that possesses remarkable durability and hitting strength comprising a new type of handle construction that creates a helical groove pattern in the surface of the bat in the handle area to provide protection from breaking and shattering bats, and also to provide improved hitting energy.

15 Claims, 2 Drawing Sheets

HELIX WOOD BASEBALL BAT

This application claims priority from U.S. Provisional Patent Application Ser. No. 61/461,864, filed Jan. 24, 2011 which is incorporated herein for what it teaches about helical groove patterned ball bats.

BACKGROUND OF THE INVENTION

In many sports activities, there are certain articles that need to be employed to play the sport. Such activities, for example, include baseball and softball in which bats are used to hit the balls.

Currently, these articles are made from wood, metal, or from fiberglass, where the rules of the sport allow. However, all of these forms of the articles are subject to breakage and it is common to observe, for example, a baseball player swing at a pitched ball and break the bat when contact is made between the bat and the ball. This breakage is dangerous, ranging from portions of the broken bat hitting players or fans, to sharp pieces of the broken bat piercing the player's hands and arms.

The invention disclosed and claimed herein is a unique new single piece bat that possesses remarkable durability and hitting strength.

THE INVENTION

This invention deals primarily with a new type of handle construction that creates a helical groove pattern in the surface of the bat in the handle area.

This unique grooving creates a shock baffling system that disperses the stress created by the bowing of the bat upon contact with the ball. By dispersing the stress, the handle is less likely to undergo catastrophic failure. Secondly, the increase in controlled flexion of the handle dissipates the shock of hitting an object and reduces common hand sting.

Thus, the invention is a ball bat, wherein the ball bat comprises a handle, a barrel, and a knob at one terminus of the handle. The ball bat has a helical groove pattern in the surface of the bat extending from the knob along the surface of the handle to the beginning of the barrel. The helical groove contains in it a high strength cord. The cord is secured in the helical groove by a durable cured resin and the cord is covered by a flexible tape. The bat and the tape are covered by a durable finish cured over them.

Another embodiment of this invention is a method for manufacturing a helical grooved bat, the method comprising providing a bat, wherein the bat has a handle, a knob at a terminus of the handle and, a barrel.

Routing two grooves ⅛" wide by 1/32" deep in the bat wherein each groove has a beginning point. The beginning point is at the juncture of the knob and the handle and the beginning points are located 180° from each other. The grooves have a helix pattern and the grooves terminate at a point where the handle meets the barrel.

Thereafter, providing a high strength braided cord in the grooves and securing the braided cord with a first curable resin. Thereafter, covering and securing the high strength braided cords with flexible tape.

Finally, overcoating the entire bat with at least one coating of a second curable resin and curing the second curable resin.

DETAILED DESCRIPTION OF THE INVENTION

Figure 1:
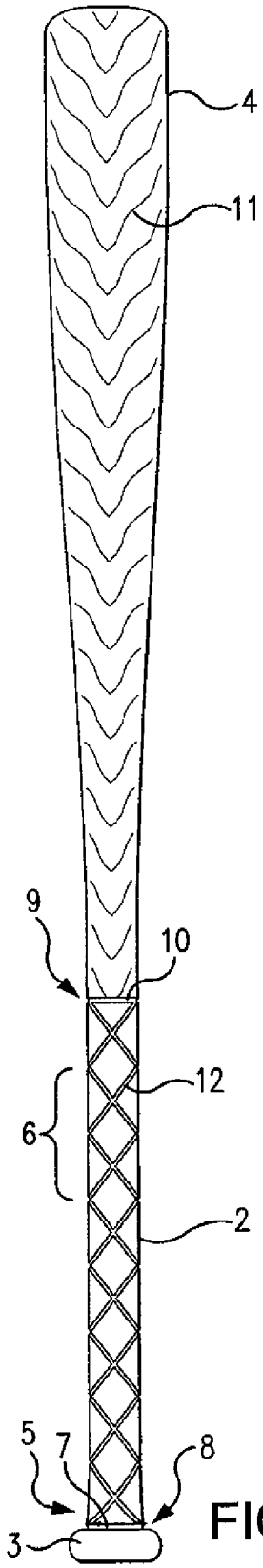
FIG. 1 is a full view of a bat of this invention.

Turning now to FIG. 1 of this invention, there is shown a full view of a bat 1 of this invention in which there is shown a handle 2, a knob 3 on a terminal end 5 of the handle 2, and a barrel 4. Also shown are the grooves 12 of the helical pattern 6 that is the essence of this invention. Further, there is shown a circumferential groove 7 at the juncture 8 of the knob 3 and the handle 2, and an additional circumferential groove 10 in the bat 1 at the juncture 9 of the handle 2 and the barrel 4.

Figure 2:
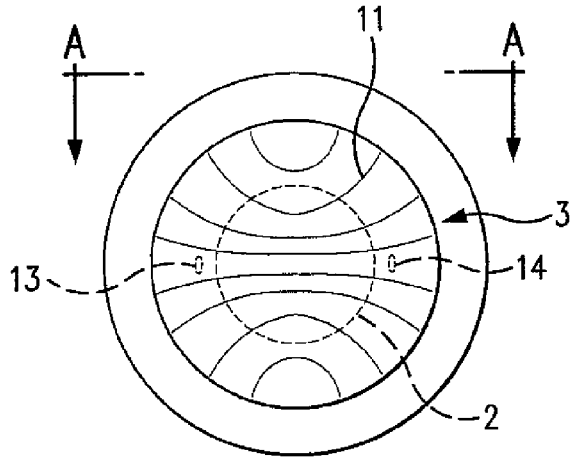
FIG. 2 is a full end view of the bat from the knob end.

FIG. 2 is a full end view of the bat 1 from the knob 3 end, showing the grain 11 of the bat 1 (also shown in FIGS. 1 and 3), and the end of the handle 2 in phantom. Also shown in this Figure are the beginning points 13 and 14 of the helical grooves, also in phantom.

Figure 3:
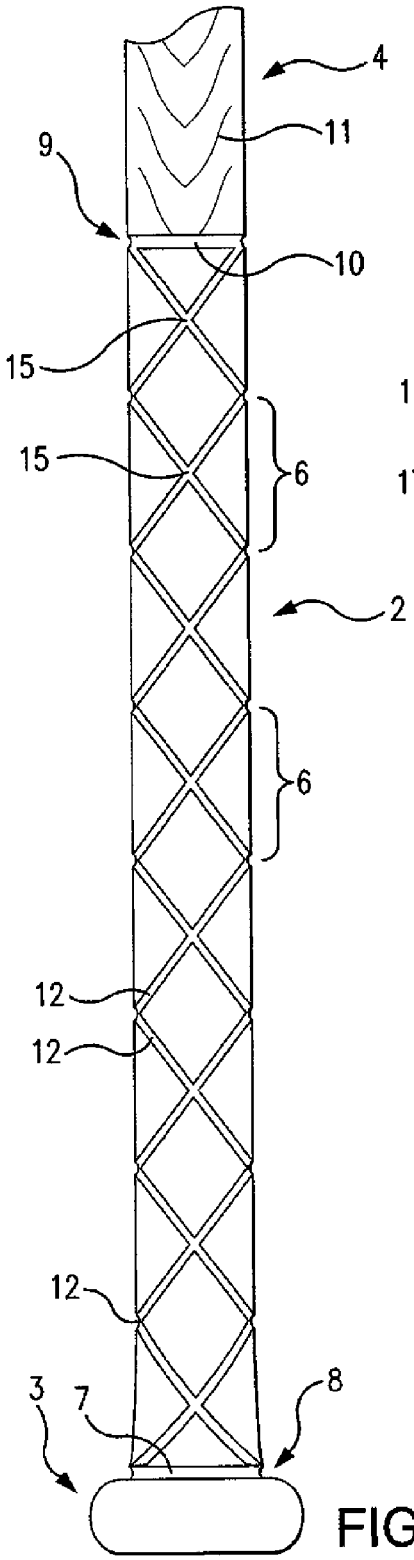
FIG. 3 is an enlarged handle of a bat of this invention showing the detail of the helical groove pattern.

Turning now to FIG. 3, which is an enlarged handle of a bat 1 of this invention, there is shown the handle 2, a knob 3, barrel 4, grooves 12 of the helical pattern 6, a circumferential groove 7 at juncture 8 of the knob 3 and the handle 2, and, circumferential groove 10 at the juncture 9 of the handle 2 and the barrel 4. The grooves 6 as shown at points 20 are accentuated to show them more clearly and it should be understood that these the grooves 6 are fully filled when the braided cord 16 and the flexible tape 17 are in place.

The grooving creates a shock baffling system that disperses the stress created by the bowing of the bat upon contact with the ball. By dispersing the stress, the wood handle is less likely to undergo catastrophic failure. Secondly, the increase in controlled flexion of the handle dissipates the shock of hitting an object and reduces hand sting.

With regard to the manufacture of the bat of this invention, the groove formation is achieved with a routing jig which routs a ⅛" wide by 1/32" deep set of grooves beginning at the knob end of the handle, such beginnings located 180 degrees from each other at the junction 8 of the knob 3 and the handle 2. Each set of grooves 6 moves up the handle in opposition to each other to create a helical pattern 12 as shown in FIG. 3. A circumferential groove is 7 created of the same dimensions at the junction 8 and another circumferential groove 10 is placed at the termination of the helical pattern at the junction 9.

In a youth bat, the junction 9 is about 15 to 16 inches from the very end of the knob 3 and in an adult bat, this groove is about 17 to 18 inches from the very end of the knob 3.

The junctions of the nodes 15 are centered on the face grain of the bat 1. In a typical pattern 12, the node junctions 15 are about 1 and ½ inches apart.

Figure 4:
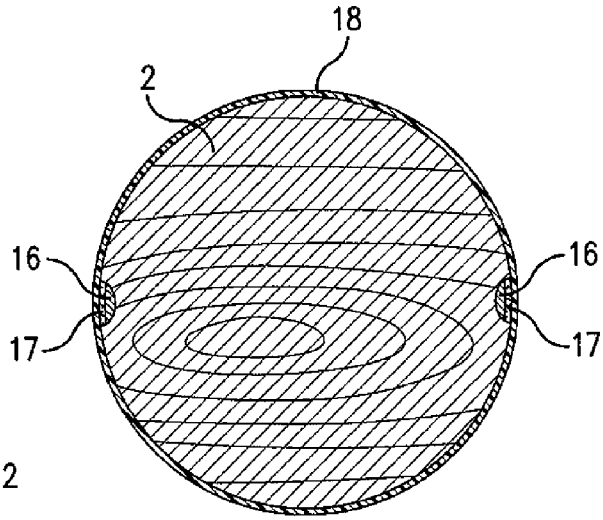
FIG. 4 is a cross sectional view of the handle taken through line A-A of FIG. 2.

After the grooves 6 are routed, they are inlaid with a high strength braided cord 16 (See FIG. 4). By "high strength", it is intended that the braided cord 16 of this invention have strength of from about 30# to about 80# test Spider wire fishing line.

The braided cord 16 is fixed into place by a low viscosity curable penetrating epoxy resin. Thereafter, the braided cord 16 is overlaid with a flexible tape 17. The flexible tape 17 can be any plastic or polymeric tape that will flex as the braided cord 16 is flexed. Thereafter, the entire bat is overcoated with a curable epoxy resin 18 and cured. It should be understood that the bat at this stage can be overcoated with several layers of curable resin if desired, and that some of the portions of the bat, for example, the barrel 4, can be colored or dyed using such resins. It should also be understood that the flexible tapes can be colored to create more brilliant patterns.

The purpose of the braided cord 16 in the groove 6 is to create a region of fracture restriction. Should the bat handle fracture, the weaved cord 16 provides sufficient resistance to the bat pieces separating and will not allow bat fragments to fly off and potentially cause serious injury. The unique helical grooving pattern allows the handle of the bat to flex over multiple points instead of just one as well as acting as a shock baffle to eliminate hand sting.

In addition, the bat of this invention has a unique feature in that the bat virtually launches the ball off the bat with little or no effort. The handle hyper-flexes much like a catapult and as the handle releases, it injects the stored energy of the flexed handle back into the ball.

What is claimed is:

1. A ball bat, said ball bat comprising a handle, a barrel, a knob at one terminus of the handle, said ball bat having a helical groove pattern in the surface of the bat extending from said knob along said surface of said handle to said barrel, said helical groove containing therein a high strength cord, said cord secured in said helical groove by a durable cured resin, said cord being covered by a flexible tape, said bat and said tape being covered by a durable finish cured thereon.

2. A ball bat as claimed in claim 1 wherein said cord is polymer braided cord.

3. A ball bat as claimed in claim 1 wherein said helical groove pattern averages ⅛ inch wide by 1/32 inches deep.

4. A ball bat as claimed in claim 1 wherein, in addition, there is a circumferential groove containing a high strength cord covered by a flexible tape at a junction of said knob and said handle.

5. A ball bat as claimed in claim 1 wherein, in addition, there is a circumferential groove containing a high strength cord covered by a flexible tape at the termination of said helical groove pattern on said barrel of said bat.

6. A ball bat as claimed in claim 1 wherein, in addition, there is a circumferential groove containing a high strength cord covered by a flexible tape at the junction of said knob and said handle, and at the termination of said helical groove pattern on said barrel of said bat.

7. A ball bat as claimed in claim 1 wherein said helical groove pattern has starting points at the knob wherein said starting points begin 180° from each other.

8. A ball bat as claimed in claim 1 wherein said helical groove pattern terminates on said handle approximately 17.5 inches from said knob.

9. A ball bat as claimed in claim 1 wherein a portion of said finish is colored.

10. A ball bat as claimed in claim 1 wherein a portion of said tape is colored.

11. A ball bat as claimed in claim 1 wherein said bat is manufactured from wood.

12. A ball bat as claimed in claim 11 wherein said bat is manufactured from hard wood.

13. A ball bat as claimed in claim 11 wherein said starting points of the helical groove pattern are aligned with the long grain of the wood.

14. A ball bat as claimed in claim 1 wherein said bat is manufactured from fiberglass.

15. A method of manufacturing a helical groove pattern bat, said method comprising:

providing a bat, said bat having a handle, a knob at a terminus of the handle and, a barrel;

routing two grooves ⅛" wide by 1/32" deep in said bat, each groove having a beginning point, said beginning point being at the juncture of said knob and said handle, said beginning points located 180° from each other, said grooves having a helix pattern, said grooves terminating at a point where said handle meets said barrel;

providing a high strength braided cord in said grooves and securing said braided cord with a first curable resin;

covering and securing said high strength braided cords with flexible tape;

overcoating said entire bat with at least one coating of a second curable resin and curing said second curable resin.

* * * * *